US007918113B2

(12) United States Patent
Liu et al.

(10) Patent No.: US 7,918,113 A0
(45) Date of Patent: Apr. 5, 2011

(54) PRESS-BUCKLED LOCK

(76) Inventors: Che-Wen Liu, Taipei (TW); Chien-Cheng Liu, Taipei (TW)

( * ) Notice: Subject to any disclaimer, the term of this patent is extended or adjusted under 35 U.S.C. 154(b) by 886 days.

(21) Appl. No.: 11/047,487

(22) Filed: Feb. 1, 2005

(65) Prior Publication Data

US 2006/0169012 A1 Aug. 3, 2006

(51) Int. Cl.
*E05B 13/10* (2006.01)

(52) U.S. Cl. ..... 70/224; 70/216; 70/222; 70/473; 70/478; 292/336.3

(58) Field of Classification Search ..... 70/207, 70/209–210, 215–216, 218, 221, 224, 472–473, 70/478–480, DIG. 20; 292/336.3
See application file for complete search history.

(56) References Cited

U.S. PATENT DOCUMENTS 2,662,387 A * 12/1953 Hagstrom ..... 70/479
2,669,474 A * 2/1954 Kanell ..... 70/224
2,702,466 A * 2/1955 McConnell ..... 70/479
3,456,974 A * 7/1969 Moore ..... 70/478
5,934,117 A * 8/1999 Shen ..... 70/224
5,941,108 A * 8/1999 Shen ..... 70/224
6,038,894 A * 3/2000 Hu ..... 70/224
6,041,630 A * 3/2000 Shen ..... 70/224
6,223,567 B1 * 5/2001 Fadul ..... 70/224
6,705,138 B1 * 3/2004 Shen ..... 70/224
2002/0104345 A1 * 8/2002 Wang ..... 70/224

* cited by examiner

*Primary Examiner* — Suzanne Dino Barrett
*Assistant Examiner* — Christopher Boswell

(57) ABSTRACT

A press-buckled lock having a press buckle is used so that the operation of locking and unlocking can be performed rapidly. By pressing the buckle, the door can be locked rapidly. When the inner handle is rotated, the press buckle is separated rapidly to unlock. Other than making the operation easy, the installation of the press buckle at the inner handle of a lock will reduce the manufacturing cost and cause the operation to be easy. Thereby the cost is reduced. By pressing the press buckle, a lock can locked rapidly; when rotating the inner handle or inserting a specific key into the lock core, the press buckle will separate rapidly so as to unlock the lock; thus, the press buckle in the lock has the effect of controlling the locking and unlocking operation rapidly.

1 Claim, 7 Drawing Sheets

PRESS-BUCKLED LOCK

FIELD OF THE INVENTION

The present invention relates to locks, and particularly to a press-buckled lock, wherein a press buckle is installed. By pressing the buckle, the door can be locked rapidly. When the inner handle is rotated, the press buckle is separated rapidly to unlock. Other than making the operation easy, the installation of the press buckle at the inner handle of a lock will reduce the manufacturing cost and cause the operation to be easy. Thereby the cost is reduced.

BACKGROUND OF THE INVENTION

In the current used lock, the door handle is combined with the lock. The function of the handle is to reduce a lock tongue of the lock seat inwards so as to separate from the lock tongue seat to achieve the object of unlocking. An outer side of the door lock has a lock hole for receiving a key to rotate therein so as to achieve the object of locking and unlocking. In such a structure, the locking of the door is controlled by rotating the switch at the inner side of a door. It is not a convenient way. The process in manufacturing and installation is completed and the cost is high. It is not an ideal way.

SUMMARY OF THE INVENTION

Accordingly, the primary object of the present invention is to provide a press-buckled lock, wherein a press buckle is used so that the operation of locking and unlocking can be performed rapidly.

To achieve object, the prior art rotation switch is changed as a press buckle. By pressing the buckle, the door can be locked rapidly. When the inner handle is rotated, the press buckle is separated rapidly to unlock. Other than making the operation easy, the installation of the press buckle at the inner handle of a lock will reduce the manufacturing cost and cause the operation to be easy. Thereby the cost is reduced.

The various objects and advantages of the present invention will be more readily understood from the following detailed description when read in conjunction with the appended drawing.

BRIEF DESCRIPTION OF THE DRAWINGS

FIG. 3-1 is a plane schematic view about the structure of the outer sleeve of the present invention.

FIG. 3-2 is a structural schematic view about the outer spring support of the present invention.

FIG. 3-3 is a plane schematic view about the positioning structure of the present invention.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
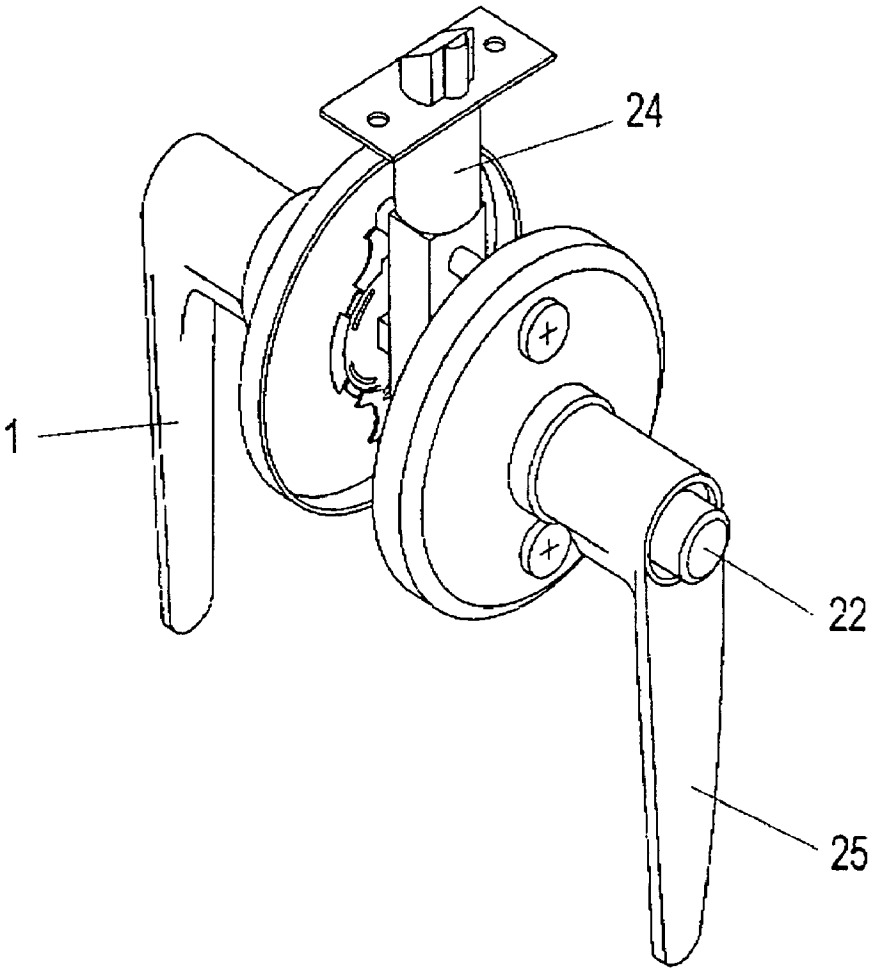
FIG. 1 is a perspective view of the present invention.
Figure 2:
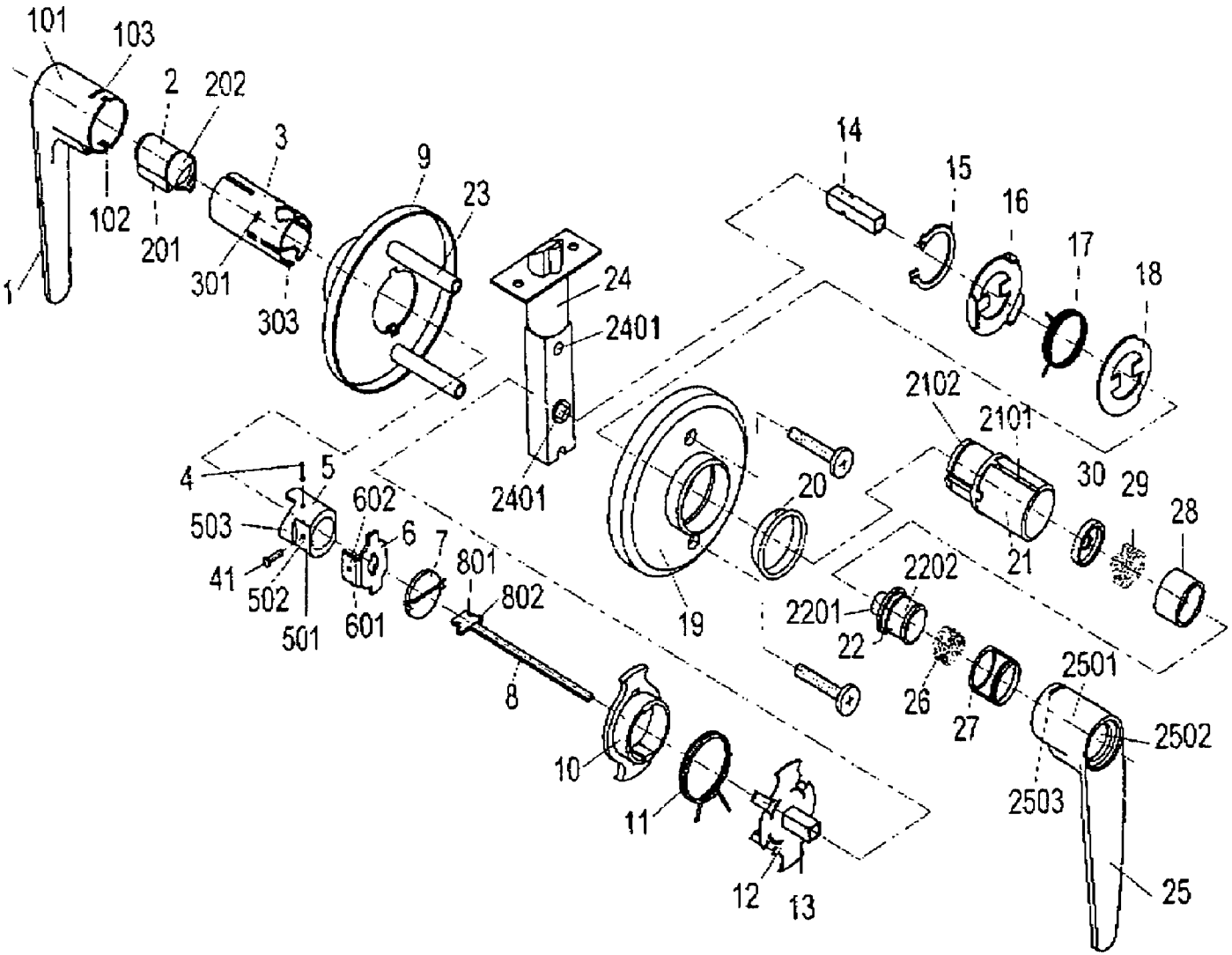
FIG. 2 is an exploded perspective view of the present invention.
Figure 4:
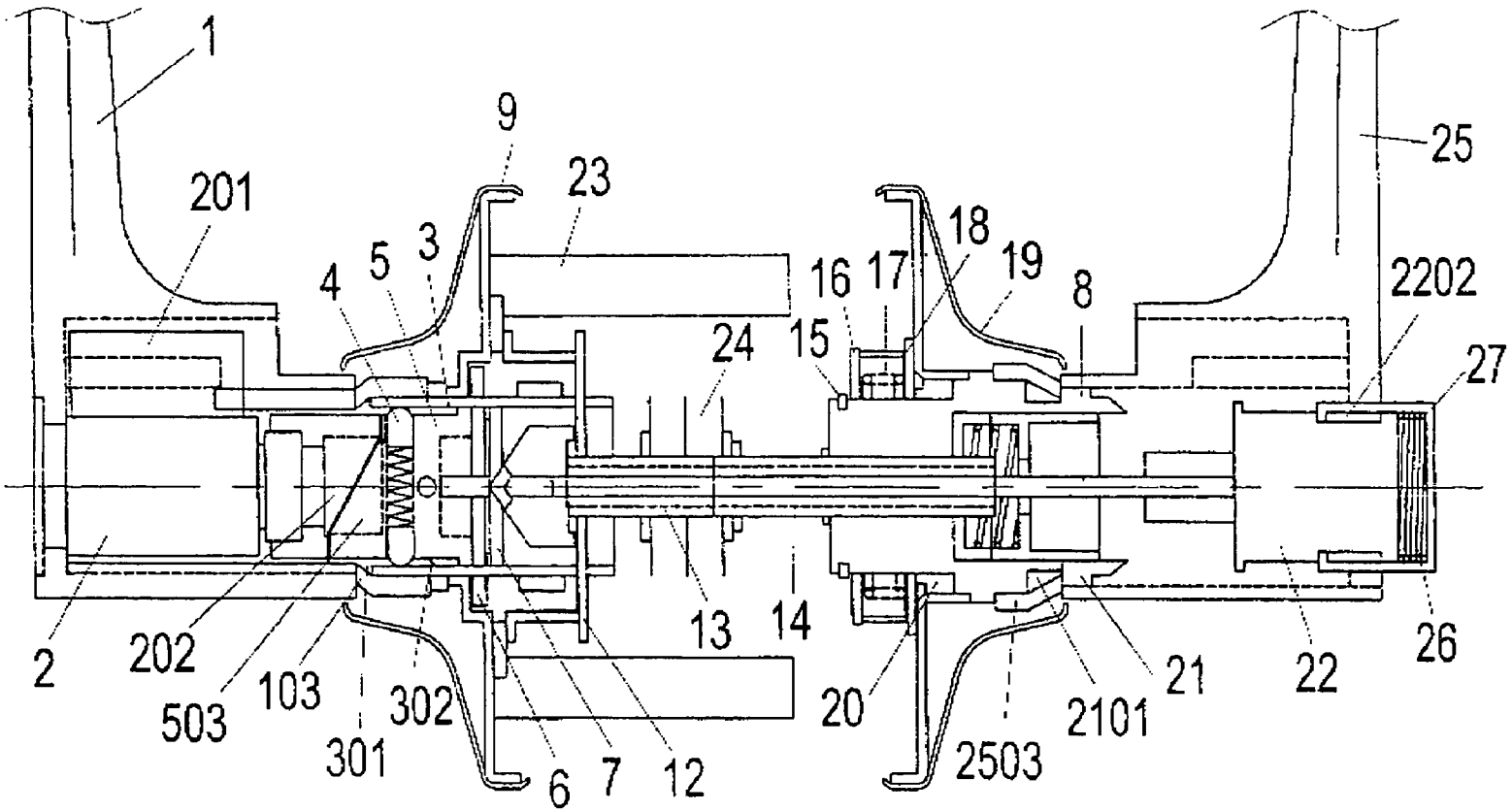
FIG. 4 is a schematic view showing the operation of the present invention.

With reference to FIGS. 1, 2, and 4, the perspective view, exploded view and cross sectional view of the present invention is illustrated. The present invention includes the following elements.

An inner sleeve 21 is a hollow body. A washer 20 encloses a middle section of the inner sleeve 21.

A press buckle 22 has an extension portion 2201 at a front end thereof. The extension portion 2201 inserts into a rear end of a round sleeve 28. Another end of the round sleeve 28 has an opening. A spring 29 is installed in the opening. A front end of the round cover 29. A bottom cover 30 is embedded into the opening of the round sleeve 28. Then the round sleeve 28 is placed into a rear side of the inner sleeve 21. The press buckle 22 has a head portion 2202 at a rear end thereof. A spring 26 is installed to the head portion 2202 of the press buckle 22. A periphery of the spring 26 is enclosed by an actuating sleeve 27.

An inner handle 25 has a head portion 2501. The press buckle 22 with the inner sleeve 21 are received within the inner handle 25. The head portion 2202 of the press buckle 22 is inserted into a round hole 2502 at one end of the inner handle 25 so as to protrude out of the inner handle 25. Part of the actuating sleeve 27 is inserted into the head portion 2501 of the inner handle 25 and other part thereof is exposed out of the head portion 2502 of the inner handle 25. The inner sleeve 21 is received within the inner handle 25 so as to be combined thereto. An upper end of the inner handle 25 is pressed so that a buckle tip 2503 at the inner side of the inner handle 25 (in the drawing, the outer side of the buckled tip 2503 is pressed inwards so that the interior of the inner handle 25 is formed with the buckled tip 2503) is buckled into a recess 2102 at an upper side of the inner sleeve 21 so as to prevent the inner handle 25 to move out.

An inner panel 19 has a central hole. The inner sleeve 21 passes through the inner panel 19 so that the inner panel 19, inner sleeve 21 and the inner handle 25 are assembled as an integral body. Then a confining sheet 18, a second resilient spring 17, and an inner spring seat 16 sequentially pass through the inner panel 19. An elastic opening ring 15 is embedded into an annular trench 2102 at a front end of the inner sleeve 21 as a confinement.

Figures 1, 3:
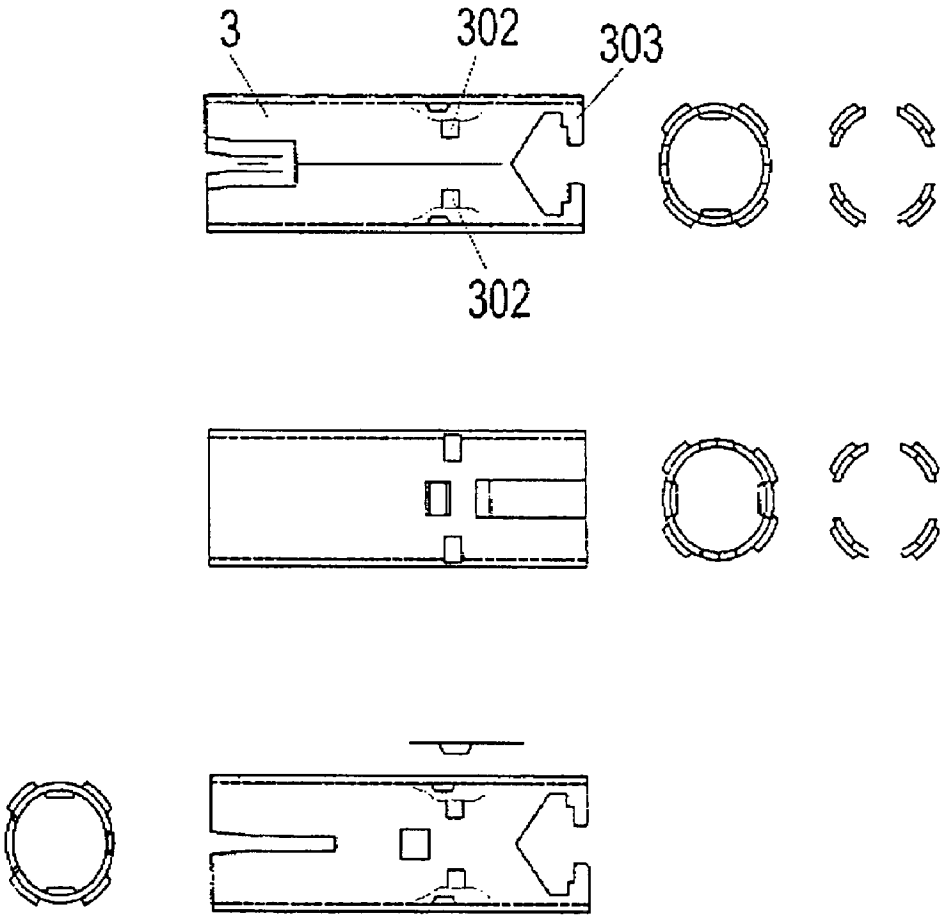
Figures 2, 3:
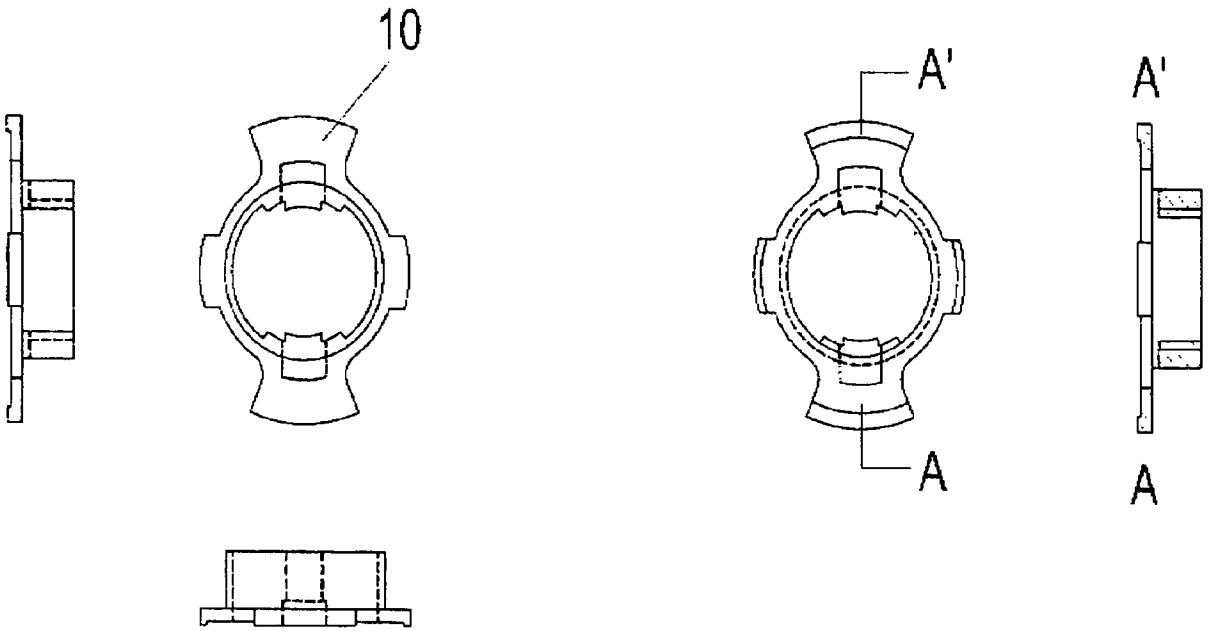
Figure 3:
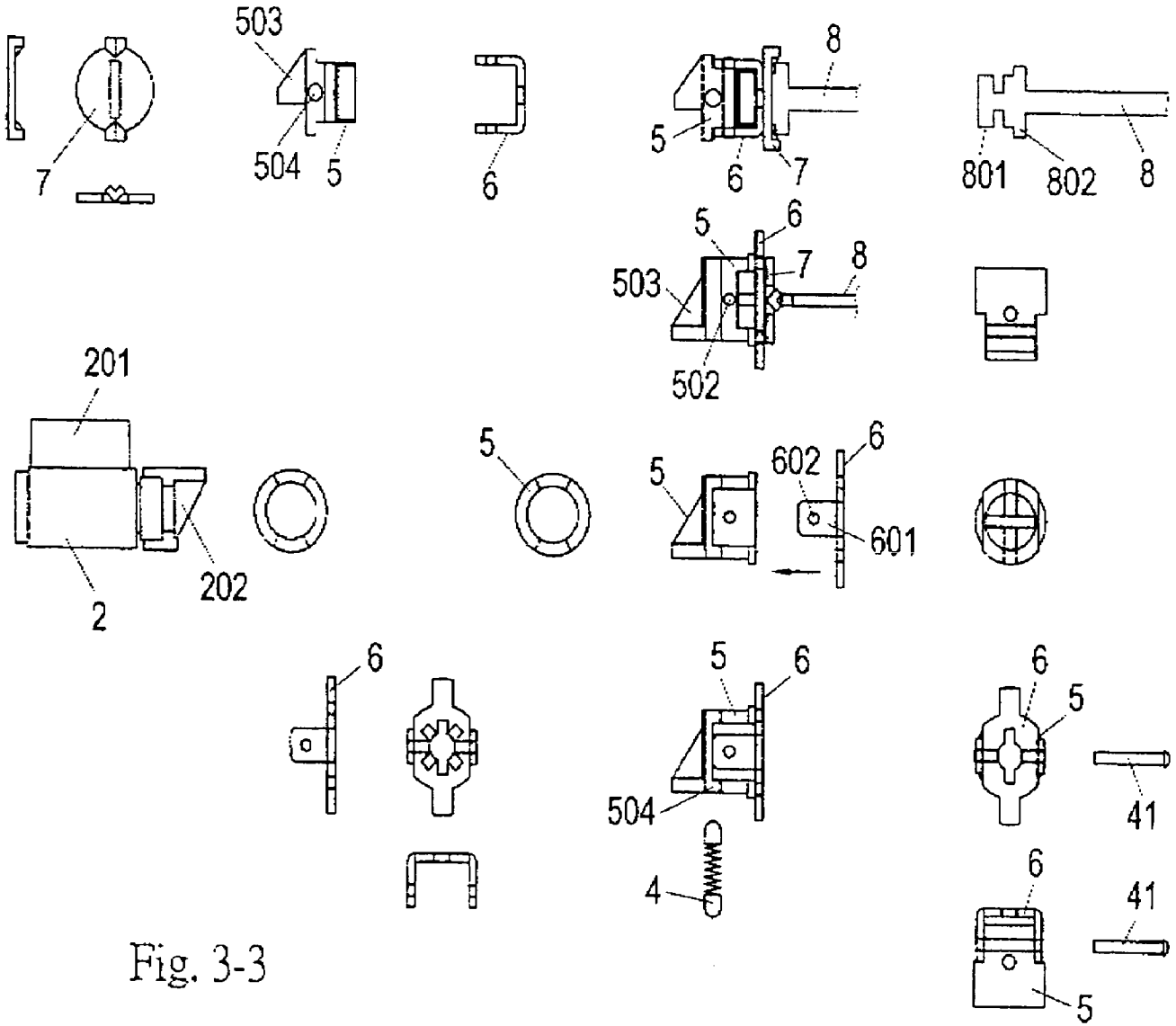

An outer sleeve 3 is included, see FIG. 3-1. An inner wall of the outer sleeve 3 has two projections 302. One end of the outer sleeve 3 has four connecting sheets 303.

A lock core 2 is combined within the outer sleeve 3. The lock core 2 has a projection 201. A front end of the lock core 2 has a guide structure 202.

An outer handle 1 has a head portion 101. An inner side of the outer handle 1 has a buckled tip 103 (in the drawing, the outer side of the buckled tip 103 is pressed inwards so that the interior of the outer handle 1 is formed with the buckled tip 103) The outer sleeve 3 and the lock core 2 are placed in the head portion 101 of the outer handle 1. The projection 201 of the lock core 2 is buckled into a long hole 102 at the head portion 101 of the outer handle 1. The buckled tip 103 is buckled in a recess 301 on an outer periphery of the outer sleeve 3 so as to prevent the outer handle 1 to protrude out. The guide structure 202 has a plurality of protrusions. A plurality of guiding recess is formed between two protrusions. A top of each protrusion is formed with a tip teeth. The outer sleeve 3 passes through the outer panel 9 and a front section of the outer sleeve 3 protrudes out thereof.

A buckling rod 8 has front section 802 and a rear section 801 which are as an H shape. A positioning sheet 7 is positioned in a middle section of the two sections 801, 802. The rear section 801 is engaged with a positioning seat 6. Two sides of the positioning seat 6 have respective ears 601 which are inserted into the lateral recesses 501 at two sides of a positioning unit 5. Each ear 601 has a penetrating hole 602 corresponding to a penetrating hole 502 in a corresponding recess 501 of the positioning unit 5 for receiving a pin 401 so as to fix the positioning seat 6 to the positioning unit 5. Thus, the front section 801 of the buckling rod 8 is confined in the positioning unit 5. Thereby the buckling rod 8, positioning sheet 7, positioning seat 6 and positioning unit 5 are formed as an integral body. A front section of the positioning unit 5 has a guide out unit 503 which is formed by a plurality of blocks. A plurality of guide trenches are formed between the blocks. One side of each block (see FIG. 3-3) is an inclined surface so that the block is formed as a tip teeth. A lateral side of the positioning unit 5 has a through hole 504 at a lateral side thereof for receiving a positioning spring 4.

With reference to FIG. 3-3, it is illustrated that the buckling rod 8, positioning sheet 7, positioning seat 6, and positioning unit 5 are inserted into the outer sleeve 3. The positioning spring 4 are buckled to the two projections 302 at the inner wall of the outer sleeve 3. See FIG. 4, the four connecting sheets 303 at one end of the outer sleeve 3 are inserted into the lock core 2 so as to confine the buckling rod 8, positioning sheet 7, positioning seat 6, and positioning unit 5 not to fall out. A outer tube 23 is installed between the outer panel 9 and the inner panel 19. The buckling rod 8 inserts through a first rectangular iron tube 13 and a second rectangular iron tube 14. The outer tube 23, first rectangular iron tube 13 and second rectangular iron tube 14 are inserted into a switch hole 2401 of a lock seat 24. Thereby by driving the two handle, the lock seat 24 is driven to insert a rear section of the buckling rod 8 into the inner sleeve 21 so as to be further inserted into an interior of the press buckle 22 in the inner handle 25 and confine above mentioned elements.

Referring to FIG. 4, a schematic cross view is illustrated, where the present invention is realized to a lock at an outer side of a door. The press buckle 22 of the inner handle 25 can be pressed from the inner side of a door. The guide unit 503 at a front end of the positioning unit 5 pivotally connecting to the buckling rod 8 is driven by the press bar 22 so as to be engaged to the guiding structure 202 of the lock core 2 at the interior of the outer handle 1. The positioning spring 4 in the positioning unit 5 will buckle the two projections 302 of the outer sleeve 3 so that if it is desired to rotate the outer handle 1 to drive the outer sleeve 3, the guide out structure 503 at a front end of the positioning unit 5 will be engaged to the guide structure 202 of the lock core 2 so that the outer handle 1 can not be rotated. Thus it can not be opened from outer side.

Figure 5:
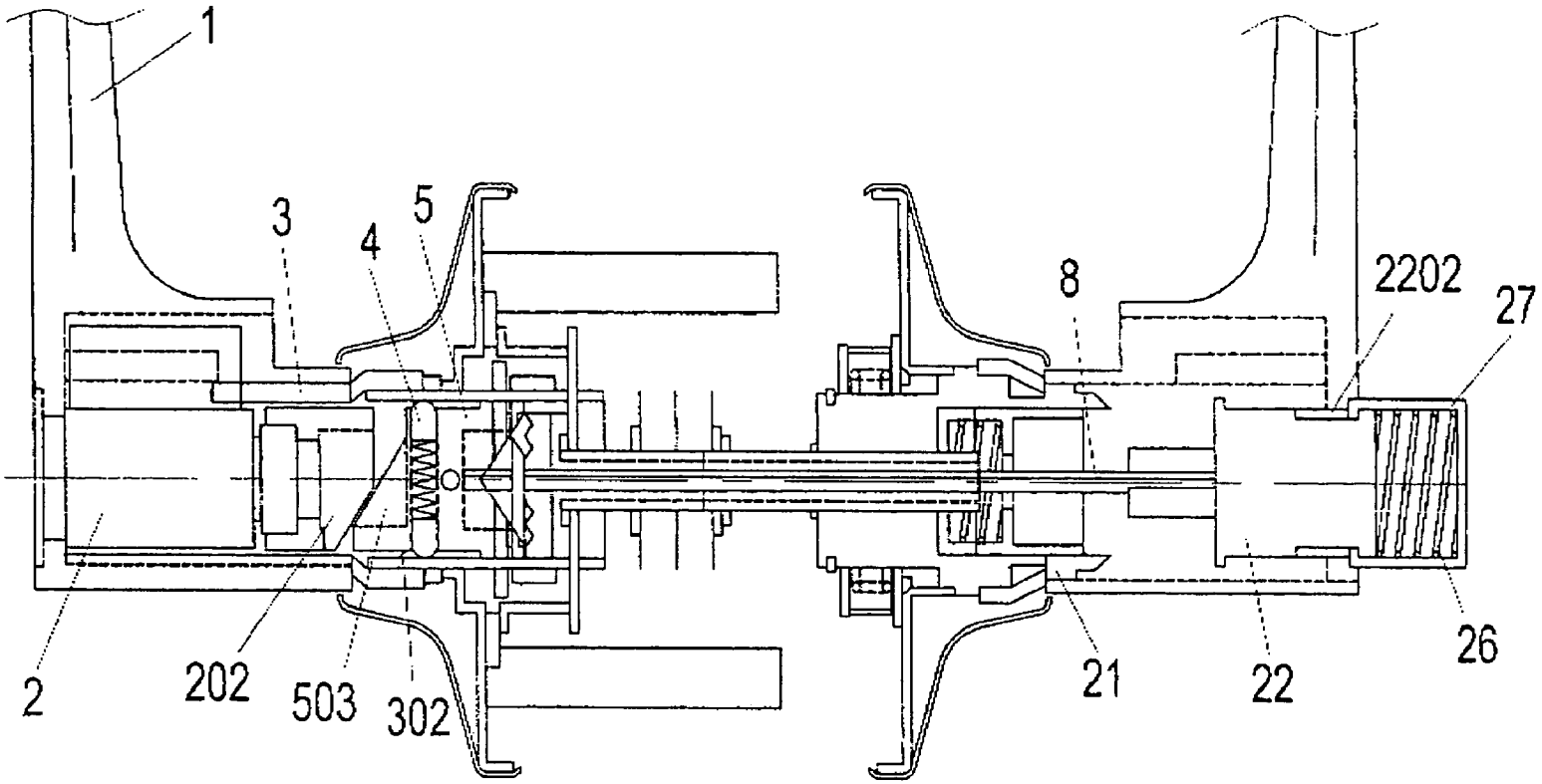
FIG. 5 is a schematic view showing another operation of the present invention.

With reference to FIG. 5, the schematic cross view about the operation of the present invention is illustrated. When a key is inserted into the lock core 2 from the outer handle 1 at the outer side of the door, the rotate of the key will cause the guide structure 202 at the front end of the lock core 2 to rotate. Thus, the guide out structure 503 at the front end of the positioning unit 5 driving by the buckling rod 8 will rotate in the outer sleeve 3 so as to drive the buckling rod 8 to rotate through an angle until the positioning spring 4 in the positioning unit 5 can not be buckled to the two projections 302 at the inner walls of the outer sleeve 3 so as to separate therefrom. As a result, the positioning seat 6, positioning sheet 7 and the buckling rod 8 driven with the positioning unit 5 are pushed out. The press buckle 22 firmly secured at the distal end of the buckling rod 8 retracts out from the inner sleeve 21 so that the head portion 2202 of the press buckle 22 protrudes out so as to achieve the object of unlocking. The user out of the door may rotate the outer handle 1 to open the door. Furthermore, the hand inside the door will press the press buckle 22 on the inner handle 25 so as to lock the door. Furthermore, the inner handle 25 is rotated to achieve the object of unlocking. at the time of rotating the inner handle 25, the buckling rod 8 rotates by the driving of the press buckle 22. As a result, the guiding out structure 503 at the front end of the positioning unit 5 driving by the buckling rod 8 will rotate at the outer side of the outer sleeve 3 so that the positioning seat 6, positioning sheet 7, and buckling rod 8 driven by the positioning unit 5 will push out. The positioning spring 4 in the positioning unit 5 will separate from the two projections 302 at the inner wall of the outer sleeve. Similarly, the press bar 22 firmly secured to the distal end of the buckling rod 8 will retract out from the inner sleeve 3 so that the head portion 2202 of the press buckle 22 protrudes out. Thereby the object of unlocking is achieved.

Advantages of the present invention will be described herein. The present invention has a simple structure so that the manufacturing process is simplified and the cost is reduced. Furthermore, the installation of the press bar causes that the operations of the locking and unlocking are convenient.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A press-buckled lock comprising:

an inner sleeve being a hollow body; a washer enclosing a middle section of the inner sleeve;

a press buckle having an extension portion at a front end thereof; the extension portion inserting into a rear end of a round sleeve; another end of the round sleeve having an opening; a spring being installed in the opening; a front end of the round cover; a bottom cover being embedded into the opening of the round sleeve; then the round sleeve being placed into a rear side of the inner sleeve; the press buckle having a head portion at a rear end thereof; a spring being installed to the head portion of the press buckle; a periphery of the spring being enclosed by an actuating sleeve;

an inner handle having a head portion; the press buckle with the inner sleeve being received within the inner handle; the head portion of the press buckle being inserted into a round hole at one end of the inner handle so as to protrude out of the inner handle; part of the actuating sleeve being inserted into the head portion of the inner handle and other part thereof being exposed out of the head portion of the inner handle; the inner sleeve being received within the inner handle so as to be combined thereto; an upper end of the inner handle being pressed so that a buckle tip at the inner side of the inner handle being buckled into a recess at an upper side of the inner sleeve so as to prevent the inner handle to move out;

an inner panel having a central hole; the inner sleeve passing through the inner panel so that the inner panel, the inner sleeve and the inner handle being assembled as an integral body; then a confining sheet, a second resilient spring, and an inner spring seat sequentially passing through the inner panel; an elastic opening ring being embedded into an annular trench at a front end of the inner sleeve as a confinement;

an outer sleeve; an inner wall of the outer sleeve having two projections; one end of the outer sleeve having four connecting sheets;

a lock core being combined within the outer sleeve; the lock core having a projection; a front end of the lock core having a guide structure;

an outer handle having a head portion; an inner side of the outer handle having a buckled tip; the outer sleeve and the lock core being placed in the head portion of the outer handle; the projection of the lock core being buckled into a long hole at the head portion of the outer handle; the buckled tip being buckled in a recess on an outer periphery of the outer sleeve so as to prevent the outer handle to protrude out; the guide structure having a plurality of protrusions; a plurality of guiding recess being formed between two protrusions; a top of each protrusion being formed with a tip teeth; the outer sleeve passing through the outer panel and a front section of the outer sleeve protruding out thereof;

a buckling rod having a front section and a rear section which are formed as an H shape; a positioning sheet being positioned in a middle section of the two sections; the rear section being engaged with a positioning seat; the sides of the positioning seat having respective ears which are inserted into the lateral recesses at two sides of a positioning unit; each ear having a penetrating hole corresponding to a penetrating hole in a corresponding recess of the positioning unit for receiving a pin so as to fix the positioning seat to the positioning unit; thus, the front section of the buckling rod being confined in the positioning unit; thereby the buckling rod, positioning sheet, positioning seat and positioning unit having formed as an integral body; a front section of the positioning unit having a guide out unit which is formed by a plurality of block; a plurality of guide trenches being formed between the blocks; one side of each block being an inclined surface so that the block is formed as a tip teeth; a lateral side of the positioning unit having a through hole at a lateral side thereof for receiving a positioning spring;

wherein in assembly, the buckling rod, positioning sheet, positioning seat, and positioning unit are inserted into the outer sleeve; the positioning spring are buckled to the two projections at the inner wall of the outer sleeve, the four connecting sheets at one end of the outer sleeve are inserted into the lock core so as to confine the buckling rod, positioning sheet, positioning seat, and positioning unit not to fall out; the outer tube is installed between the outer panel and the inner panel; the buckling rod inserts through a first rectangular iron tube and a second rectangular iron tube; the outer tube, first rectangular iron tube and second rectangular iron tube are inserted into a switch hole of a lock seat; thereby by driving the two handle, the lock seat is driven to insert a rear section of the buckling rod into the inner sleeve so as to be further inserted into an interior of the press buckle in the inner handle and confine above mentioned elements;

wherein by pressing the press buckle, a lock can locked rapidly; when rotating the inner handle or inserting a specific key into the lock core, the press buckle will separate rapidly so as to unlock the lock; thus, the press buckle in the lock has the effect of controlling the locking and unlocking operation rapidly.

* * * * *